United States Patent [19]

Cole et al.

[11] 4,047,898

[45] Sept. 13, 1977

[54] UPGRADING OF SOLID FUELS

[75] Inventors: Edward L. Cole, Fishkill; Howard V. Hess, Glenham; James Wong, Jr., Wappingers Falls, all of N.Y.

[73] Assignee: Texaco Inc., New York, N.Y.

[21] Appl. No.: 736,626

[22] Filed: Oct. 28, 1976

Related U.S. Application Data

[63] Continuation of Ser. No. 583,387, June 3, 1975, abandoned.

[51] Int. Cl.[2] ..... C10L 9/10

[52] U.S. Cl. ..... 44/1 G; 44/1 R; 201/17

[58] Field of Search ..... 44/1 R, 1 G; 201/17; 241/17

[56] References Cited

U.S. PATENT DOCUMENTS

| | | | |
|---|---|---|---|
| 2,560,807 | 7/1951 | Lobo | 241/17 X |
| 2,830,769 | 5/1958 | Work | 241/17 X |
| 2,885,154 | 5/1959 | Eastman et al. | 241/17 X |
| 3,660,054 | 5/1972 | Rieve | 44/1 R |

*Primary Examiner*—Carl F. Dees

*Attorney, Agent, or Firm*—Thomas H. Whaley; Carl G. Ries; Robert Knox, Jr.

[57] ABSTRACT

Low rank fuels are beneficiated by treatment with water at elevated temperature under superatmospheric pressure in the presence of hydrogen.

8 Claims, No Drawings

UPGRADING OF SOLID FUELS

This is a continuation of application Ser. No. 583,387, filed June 3, 1975, now abandoned.

This invention relates to the upgrading of solid fuels. More particularly, it is concerned with the beneficiation of low rank solid fuels such as sub-bituminous coal and lignite.

Millions of tons of low rank fuels such as sub-bituminous coal and lignite exist in this country and although many of the deposits are readily mined, they are not used extensively as fuels, because for the most part, they are located at substantial distance from the point of ultimate use and in addition they have several characteristics which make them less attractive as fuels. For example, although generally they have a relatively low sulfur content, these low rank fuels still contain too much sulfur to permit their use as a fuel and still meet current regulations with respect to $SO_2$ emissions. In addition, to make these coals economically attractive, means must be found for separating the components of the coal having little or no heating value from the components having a high heating value. Thus inorganic mineral matter, water and carbon dioxide are desirably removed from such fuels to produce a fuel having a higher BTU/lb. value and thereby produce a fuel which is more economic to transport either by rail or pipeline.

It is therefore an object of this invention to provide a process for the beneficiation of low rank solid fuels such as sub-bituminous coal and lignite. Another object is to provide a process for reducing ash content of such a fuel. Another object is to increase heating value of a low rank solid fuel. Still another object is to reduce the sulfur content of such solid fuels. These and other objects will be obvious to those skilled in the art from the following disclosure.

According to our invention, there is provided a process for the beneficiation of a low rank solid fuel which comprises forming a mixture of particulate low rank solid fuel and water, heating the mixture to a temperature between about 300° and 700° F. at a pressure sufficient to maintain liquid water in the reaction zone and in the presence of hydrogen for a period of time sufficient to reduce the sulfur and ash content and increase the BTU value of the fuel.

The solid fuels to which the process of the present invention may be applied are low rank solid fuels II, III and IV as classified in the Annual Book of ASTM Standards, 1973 edition, Part 19, page 57. The solid fuel should be reduced to a particulate form in which the particles have a maximum dimension of not greater than 1 inch. Preferably, the maximum dimension is less than ½ inch and still more preferably less than ¼ inch. The water and the particulate solid fuel are mixed in an amount to provide a mixture containing from about 0.5 to 6 parts water preferably from 1 to 4 parts water per part fuel on a dry basis by weight. If the process is of the batch type, the coal and water may be charged separately to the reaction zone such as an autoclave or they may be charged together as a slurry. In such latter event, the water should be present in the slurry in an amount between about 40 and 75% by weight preferably between 40 and 60% by weight as if the water content is less than 40%, the slurry becomes difficult to pump. Such a slurry is also used when the process is of the continuous type where the slurry is, for example, passed through an elongated tubular reaction zone.

The hydrothermal treatment in the presence of added hydrogen as practiced in the process of our invention may be effected under either static or dynamic conditions. In one embodiment of our invention the slurry of solid fuel in water is introduced into a pressure vessel such as an autoclave. Since the hydrothermal treatment is effected under non-oxidizing conditions, advantageously the pressure vessel is swept with inert gas prior to the introduction of the slurry. In the alternative, the slurry is introduced into the vessel which may then be swept with hydrogen or with an inert gas and then hydrogen. After removal of the oxygen-containing gases, the vessel is pressured with hydrogen and then heated under autogenous pressure to a temperature between about 300° and 700° F. preferably between 400° and 650° F., the pressure being such that water in liquid state is maintained in the reaction vessel. After a period of time between about 1 minute and 2 hours the vessel is vented and the slurry removed therefrom. Although some reaction is obtained at short time intervals of less than 5 minutes, for practical reasons, it is more desirable to maintain the reactants at the designated temperature for a period of at least 5 minutes.

In another embodiment of our invention the solid fuel water slurry is passed under conditions of turbulent flow through an elongated tubular reaction zone in the presence of added hydrogen and in the substantial absence of oxygen-containing gases. This may be done, for example, by introducing the slurry from the bottom of a slurrying vessel through a compressor into the tubular reaction zone. The slurry is passed through the tubular reaction zone under turbulent flow conditions at a temperature between about 300° and 700° F., preferably between 400° and 650° F. under a pressure sufficient to maintain liquid water in the reaction zone. In a more specific embodiment, the solid fuel-water slurry may be subjected to an initial hydrothermal treatment in the absence of hydrogen and oxygen-containing gases in a procedure in which any gaseous medium present is an inert gas such as nitrogen. The pressure is then released after a period of between about 1 minute and 2 hours at reaction conditions of temperature and pressure. Volatile material is vented from the system and the slurry pressured with hydrogen and subjected to a second hydrothermal treatment, this time in the presence of added hydrogen.

The hydrogen used in the process of our invention need not necessarily be pure but should have a purity of at least about 50 volume percent. Catalytic reformer by-product hydrogen, electrolytic hydrogen, synthesis gas per se produced by the partial oxidation of a carbonaceous or hydrocarbonaceous material and hydrogen produced by the shift conversion of synthesis gas followed by $CO_2$ removal may be used.

The following examples are submitted for illustrative purposes only and it should not be construed that our invention is restricted thereto.

EXAMPLE I

In this example the solid fuel is sub-bituminous coal having the following analysis:

Table 1

| | As Received | Moisture Free |
|---|---|---|
| Ultimate Analysis | | |
| Moisture, % | 7.0 | — |
| Carbon, % | 49.0 | 52.6 |
| Hydrogen, % | 3.1 | 3.3 |
| Nitrogen, % | 0.64 | 0.69 |

Table 1-continued

| | As Received | Moisture Free |
|---|---|---|
| Sulfur, % | 0.57 | 0.61 |
| Ash, % | 21.8 | 23.6 |
| Oxygen, % (Diff.) | 17.9 | 19.2 |
| Heat of Combustion Gross, Btu/lb. | 8500 | 9120 |

A series of three runs is made in which in Runs 1 and 2 hydrogen is used and in Run 3 nitrogen is used whereby Runs 1 and 2 are representative of the process of our invention whereas Run 3 serves as a control in which the hydrothermal treatment is carried out in the absence of added hydrogen. In these runs the autoclave is charged with a slurry of powdered coal in water and in Runs 1, 2 and 3 the autoclave is swept with nitrogen. In Runs 1 and 2 the autoclaves are then swept with hydrogen for the removal of nitrogen. The autoclaves are then pressured with the respective gases. After being held at the reaction temperature for one hour the liquid and gas phase are separated from the coal at 500° F. and while being withdrawn the liquid and gas are cooled to about 100° F. by means of a condenser and the two phases separated. The coal remaining in the autoclave is recovered and analyzed. Data from these runs is tabulated below in Table 2.

Table 2

| Run No. | 1 | | 2 | | 3 | |
|---|---|---|---|---|---|---|
| Charge Coal, grams | 185 | | 181 | | 148 | |
| Charge $H_2O$, grams | 370 | | 362 | | 296 | |
| Charge, ml gas at psig | 1270 at 300 | | 1276 at 600 | | 1390 at 200 | |
| Operating Conditions | | | | | | |
| Temp. ° F | 500 | | 500 | | 500 | |
| Pressure, psig | 1275 | | 1925 | | 1200 | |
| Time at Temp. ° F, Hrs. | One | | One | | One | |
| Products | | | | | | |
| Treated Coal, grams | 119 | | 95 | | 121 | |
| Ultimate Analyses | | mf* | | mf* | | mf* |
| Moisture, % | 4.9 | — | 5.4 | — | 5.1 | — |
| Carbon % | 57.4 | 60.2 | 56.9 | 60.1 | 55.4 | 58.5 |
| Hydrogen, % | 3.9 | 4.1 | 3.5 | 3.7 | 3.7 | 3.9 |
| Nitrogen, % | 0.76 | 0.8 | 0.75 | 0.8 | 0.7 | 0.7 |
| Sulfur, % | 0.48 | 0.51 | 0.41 | 0.43 | 0.5 | 0.53 |
| Ash, % | 18.3 | 19.2 | 19.1 | 20.2 | 19.9 | 21.0 |
| Oxygen, % | 14.26 | 15.0 | 13.94 | 14.8 | 14.7 | 15.5 |
| Gross, Btu/lb | 10,123 | 10,680 | 9,921 | 10,500 | 9,586 | 10,100 |

*moisture free

It will be noted that incorporation of the hydrogen in the hydrothermal treating step in Runs 1 and 2 as compared to Run 3 has a beneficial effect in that not only is the sulfur concentration in the material reduced but in addition the heating value of the coal is enhanced.

EXAMPLE II

In this example the solid fuel is an Alabama lignite having the following analysis.

Table 3

| | As Received | Moisture Free |
|---|---|---|
| Ultimate Analysis | | |
| Moisture, % | 47.3 | — |
| Carbon, % | 33.3 | 63.2 |
| Hydrogen, % | 2.6 | 4.9 |
| Nitrogen, % | 0.6 | 1.1 |
| Sulfur, % | 1.8–1.9 | 3.4–3.5 |
| Ash, % | 6.2 | 11.8 |
| Oxygen (diff.), % | 8.2 | 15.8 |
| Heat of Combustion Btu/lb. | 5949 | 11,276 |

Two runs are made in this example which are carried out similar to the runs in Example 1. In Run 4 the gas is hydrogen and in Run 5 the gas is nitrogen. The runs differ from those in Example 1 in that after being heated at elevated pressure the autoclave is allowed to cool to about 80° F. before the gas is vented. The water and the coal slurry are recovered from the autoclave and separated by filtration. Data on Runs 4 and 5 appear below in Table 4.

Table 4

| Run No. | 4 | | 5 | |
|---|---|---|---|---|
| Autoclave Chg. | | | | |
| Lignite, grams | 300 | | 300 | |
| Water, grams | 600 | | 600 | |
| Gas | Hydrogen | | Nitrogen | |
| Temperature, ° F | 550 | | 550 | |
| Pressure at Temp. psig | 1125 | | 1200 | |
| Time at Temp, min, | 30 | | 35 | |
| Recovered Coal grams (wet) | 244 | — | 361 | — |
| Ultimate Analysis | As Rec'd. | mf | As Rec'd. | mf |
| Moisture, % | 19.5 | — | 37.2 | — |
| Carbon, % | 63.0 | 78.3 | 46.9 | 74.6 |
| Hydrogen, % | 2.7 | 3.4 | 2.9 | 4.6 |
| Nitrogen, % | 1.0 | 1.2 | 0.7 | 1.2 |
| Sulfur, % | 2.4 | 3.0 | 2.1 | 3.3 |
| Ash, % | 8.0 | 9.9 | 8.0 | 12.2 |
| Oxygen, % (diff) | 3.4 | 4.2 | 2.2 | 3.1 |
| Gross Heat Comb-Btu/lb | 9477 | 11,773 | 7349 | 11,701 |

It will be noted that on a moisture-free basis, the lignite contains 3.4–3.5 wt. % sulfur and has a heating value of 11,276 BTU per pound. After the hydrothermal treatment of the coal-water slurry in the presence of added hydrogen, the sulfur content is reduced to 3.0 and the heating value increased to 11,773 BTU per pound. In Run 5 in which no hydrogen is added, the sulfur content of the lignite on a moisture-free basis is reduced to only 3.3% and the heating value is increased to 11,701 BTU per pound. This shows that although there is an advantage to the hydrothermal treatment alone there is a greater advantage to be obtained when the hydrothermal treatment is carried out in the presence of added hydrogen.

Coals, and particularly the low rank fuels such as sub-bituminous coal and lignite, contain substantial amounts of oxygen. The oxygen can exist as part of the mineral matter in the form of mineral oxides such as silica and alumina and as inorganic salts such as inorganic sulfates, e.g. calcium sulfate. Another portion of the oxygen can exist as part of the organic matter in the form of compounds such as alcohols and ketones.

It has been found that in the hydrothermal treatment of these coals in an inert atmosphere substantial amounts of gas is generated which contains about 90% $CO_2$. However, in the presence of hydrogen there is a competing reaction that leads to the formation of water. As a result, there is an increased cost for the process in the form of hydrogen consumption. It has now been found that a considerable saving can be effected in hydrogen consumption by carrying out the hydrothermal treatment in an inert atmosphere, venting the gases developed during the hydrothermal treatment and then conducting a second hydrothermal treatment in the presence of added hydrogen. This procedure is illustrated in the following example.

EXAMPLE III

The solid fuel in this example is a Lake DeSmet coal having the following analysis:

Table 5

| Ultimate Analysis | As Received | Moisture Free |
|---|---|---|
| Moisture, % | 19.5 | — |
| Carbon, % | 39.4 | 49.0 |
| Hydrogen, % | 3.4 | 4.2 |
| Nitrogen, % | 0.6 | 0.7 |
| Sulfur, % | 1.4 | 1.7 |
| Ash, % | 28.4 | 35.3 |
| Oxygen, % (By Diff.) | 7.3 | 9.1 |
| Heat of Combustion | | |
| Gross, BTU/lb. | 5936 | 7370 |

150 Grams of the powdered Lake DeSmet coal was placed in a 1740 ml. autoclave together with 300 ml. of distilled water. The autoclave was flushed and pressured with nitrogen to 450 psig followed by heating to 550° F. The autoclave was held at this temperature for one hour, cooled to room temperature, vented, flushed with hydrogen, and pressured with hydrogen to 400 psig. The autoclave was heated to 550° F. and held at this temperature for 24 hours and then vented; 1.45 cu. ft. of gas, 314 grams of water, and 103 gram of coal was recovered. The inspection tests on the coal follow:

Table 6

| Ultimate Analysis | As Received | Moisture Free |
|---|---|---|
| Moisture, % | 1.0 | — |
| Carbon, % | 51.0 | 51.5 |
| Hydrogen, % | 3.3 | 3.3 |
| Nitrogen, % | 0.67 | 0.67 |
| Sulfur, % | 1.1 | 1.1 |
| Ash, % | 33.3 | 33.6 |
| Oxygen, % | 4.6 | 4.7 |
| Heat of Combustion | | |
| Btu/lb., Gross | 8952 | 9042 |

In a series of experiments conducted as Example III and as Run No. 3 in Example I at a temperature of 550° F., for the hydrothermal treatment the average percent desulfurization was 28.3 and the average percent increase in gross heating value was 13.4 whereas when the hydrothermal treatment and venting was followed by hydrothermal treatment in the presence of added hydrogen as in Example III, the average percent desulfurization was 35.3 and the average percent increase in gross heating value was 22.6.

In another series of experiments, data for which are tabulated below, column A represents average results for experiments in which the pressuring gas is nitrogen and columns B and C average values when the pressuring gas is hydrogen.

Table 7

| | A | B | C |
|---|---|---|---|
| Temp. ° F. | 500 | 500 | 600 |

Table 7-continued

| | A | B | C |
|---|---|---|---|
| Sulfur, %* | 1.28 | 1.00 | 0.89 |
| % desulfurization | 24.7 | 41.2 | 47.6 |

*moisture free

These experimental data show the advantages of carrying out the hydrothermal treatment in the presence of added hydrogen, of carrying out a simple hydrothermal treatment followed by venting and then hydrothermal treatment in the presence of added hydrogen. They also show the advantages to be obtained by carrying out the treatment at 600° F. rather than 500° F.

Various modifications of the invention as hereinbefore set forth may be made without departing from the spirit and scope thereof, and therefore, only such limitations should be made as are indicated in the appended claims.

The embodiments of the invention in which an exclusive property or privilege is claimed are defined as follows:

1. In a process for the hydrothermal treatment of a low rank solid fuel in the presence of added hydrogen the improved method of reducing hydrogen consumption which comprises forming a mixture of particulate low rank solid fuel and water, heating the mixture in an inert atmosphere to a temperature between about 300° and 700° F. at a pressure sufficient to maintain the water liquid in the heating zone, venting the heating zone to release the generated gases and then subjecting the mixture to hydrothermal treatment at a temperature between about 300° and 700° F. and a pressure sufficient to maintain the water liquid in the hydrothermal zone in the presence of added hydrogen.

2. The process of claim 1 in which the temperature is between 400° and 650° F.

3. The process of claim 1 in which the solid fuel is sub-bituminous coal.

4. The process of claim 1 in which the solid fuel is lignite.

5. The process of claim 1 in which the mixture of solid fuel, water and hydrogen is passed through an elongated tubular reaction zone under conditions of turbulent flow.

6. The process of claim 1 in which the heating zone is an elongated tubular reaction zone and the mixture of solid fuel and water is passed therethrough under conditions of turbulent flow.

7. The process of claim 1 in which the second hydrothermal reaction zone is an elongated tubular reaction zone and the mixture of solid fuel and water is passed there under conditions of turbulent flow.

8. The process of claim 1 in which the temperature in each hydrothermal reaction zone is between 400° and 650° F.

* * * * *